US007231688B2

(12) United States Patent
Mudd

(10) Patent No.: US 7,231,688 B2
(45) Date of Patent: Jun. 19, 2007

(54) DIRT CUP FOR VACUUM CLEANER

(75) Inventor: Amy N. Mudd, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 606 days.

(21) Appl. No.: 10/679,845

(22) Filed: Oct. 6, 2003

(65) Prior Publication Data

US 2004/0128790 A1 Jul. 8, 2004

Related U.S. Application Data

(60) Provisional application No. 60/419,660, filed on Oct. 18, 2002.

(51) Int. Cl.
*A47L 9/16* (2006.01)
*B01D 45/12* (2006.01)

(52) U.S. Cl. ..... 15/353; 55/337; 55/429

(58) Field of Classification Search ..... 15/327.1, 15/327.2, 327.6, 327.7, 347, 350–353; 55/337, 55/429, 459.1, DIG. 3
See application file for complete search history.

(56) References Cited

U.S. PATENT DOCUMENTS

| | | | | |
|---|---|---|---|---|
| 2,785,767 | A | 3/1957 | Glidden | |
| 5,287,591 | A | 2/1994 | Rench et al. | |
| 6,003,196 | A | 12/1999 | Wright et al. | |
| 6,026,540 | A | 2/2000 | Wright et al. | |
| 6,070,291 | A | 6/2000 | Bair et al. | |
| 6,146,434 | A | 11/2000 | Scalfani et al. | |
| 6,260,234 | B1 | 7/2001 | Wright et al. | |
| 6,341,404 | B1 | 1/2002 | Salo et al. | |
| 6,353,963 | B1 | 3/2002 | Bair et al. | |
| 6,401,295 | B2 | 6/2002 | Bair et al. | |
| 6,428,589 | B1 | 8/2002 | Bair et al. | |
| 6,436,160 | B1 | 8/2002 | Stephens et al. | |
| 6,463,622 | B2 | 10/2002 | Wright et al. | |
| 6,558,453 | B2 * | 5/2003 | Sepke et al. | 95/268 |
| 6,591,446 | B2 | 7/2003 | Bair et al. | |
| 6,829,804 | B2 * | 12/2004 | Sepke | 15/347 |
| 2002/0029436 | A1 | 3/2002 | Hawkins et al. | |
| 2002/0095741 | A1 | 7/2002 | Inoue et al. | |
| 2003/0084536 | A1 * | 5/2003 | Yung | 15/351 |
| 2004/0010885 | A1 * | 1/2004 | Hitzelberger et al. | 15/352 |
| 2004/0034962 | A1 * | 2/2004 | Thur et al. | 15/353 |
| 2004/0074041 | A1 * | 4/2004 | Overvaag | 15/347 |
| 2004/0154126 | A1 | 8/2004 | Hansen et al. | |

FOREIGN PATENT DOCUMENTS

| | | |
|---|---|---|
| JP | 56-136642 | 10/1981 |
| JP | 56-136650 | 10/1981 |

* cited by examiner

*Primary Examiner*—Terrence R. Till
(74) *Attorney, Agent, or Firm*—King & Schickli, PLLC

(57) ABSTRACT

A vacuum cleaner is provided including a housing, a nozzle inlet, a suction generator carried on the housing and a dirt cup. The dirt cup includes a dirt collection chamber, a chamber inlet, a filter cavity and a chamber outlet. A filter element is received in the filter cavity. Air is axially directed into an interior chamber of the filter element and then radially discharged from that chamber.

31 Claims, 2 Drawing Sheets

DIRT CUP FOR VACUUM CLEANER

Figure 1:
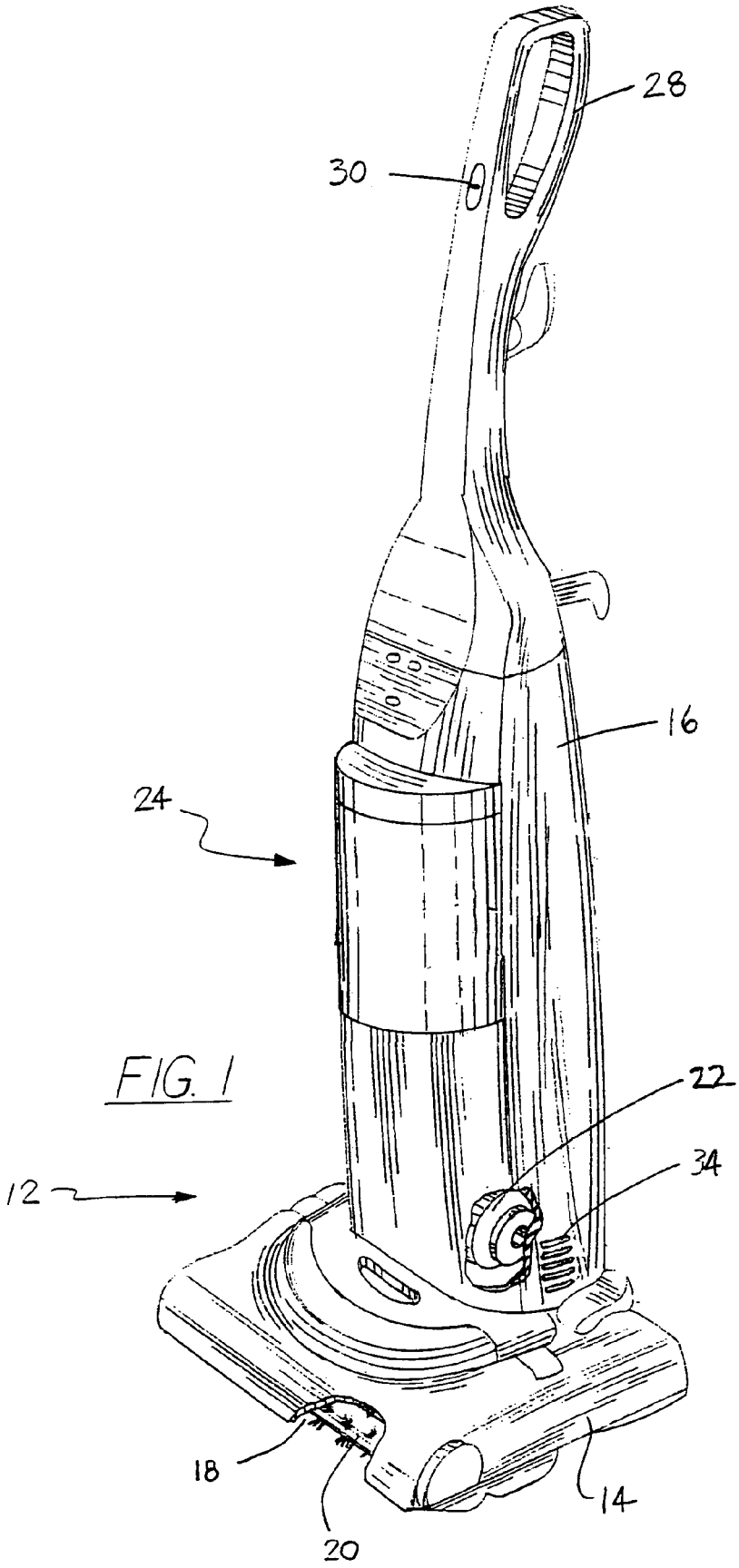

This application claims the benefit of U.S. Provisional Patent Application Ser. No. 60/419,660 filed on Oct. 18, 2002.

TECHNICAL FIELD

The present invention relates generally to the floor care equipment field and, more particularly, to a vacuum cleaner equipped with a dirt cup including a dirt collection chamber and a separate filter cavity receiving a filter element.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved vacuum cleaner incorporating a highly efficient bagless dirt collection system.

SUMMARY OF THE INVENTION

In accordance with the purposes of the present invention as described herein, an improved vacuum cleaner is provided. That vacuum cleaner includes a housing, a nozzle inlet, a suction generator carried on the housing and a dirt cup. The dirt cup includes a dirt collection chamber, a chamber inlet, a filter cavity and a chamber outlet providing fluid communication between the dirt collection chamber and the filter cavity. A filter element is received in the filter cavity.

More specifically describing the invention, the filter element includes an interior chamber, an inlet in communication with that interior chamber and a filter media through which air passes as the air exits from the interior chamber. The filter element includes a first end, a second end and a sidewall that define the interior chamber. The first end includes the inlet. The sidewall is made at least partially from a filter media. The second end wall holds a dirt trap for collecting relatively fine dirt and debris which is trapped in the interior chamber by the filter media. In one possible embodiment the filter element is cylindrical in shape.

The dirt cup includes a top wall, a sidewall and a bottom wall. The top wall may be formed by a removable lid. The inlet is provided in the sidewall. In one possible embodiment the dirt collection chamber of the dirt cup is cylindrical in shape and the inlet is substantially tangentially directed relative to the dirt collection chamber.

The filter cavity is formed in the bottom wall. Further, the chamber outlet is provided in the bottom wall. A screen may be provided over the chamber outlet so as to ensure that relatively coarse dirt and debris does not pass from the dirt collection chamber to the filter cavity.

In yet another embodiment the filter cavity may be frustoconical in shape. Thus, the filter cavity may flare from the inlet end toward the outlet end. Further, in one possible embodiment at least a portion of the dirt collection chamber is annular in shape. Additionally, a conduit may be provided between the chamber outlet and the filter cavity.

Still further, the housing of the vacuum cleaner may include a nozzle section including the nozzle inlet and a canister section. The nozzle section and the canister section may be pivotally connected together.

In the following description there is shown and described a preferred embodiment of the invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

Figure 2:
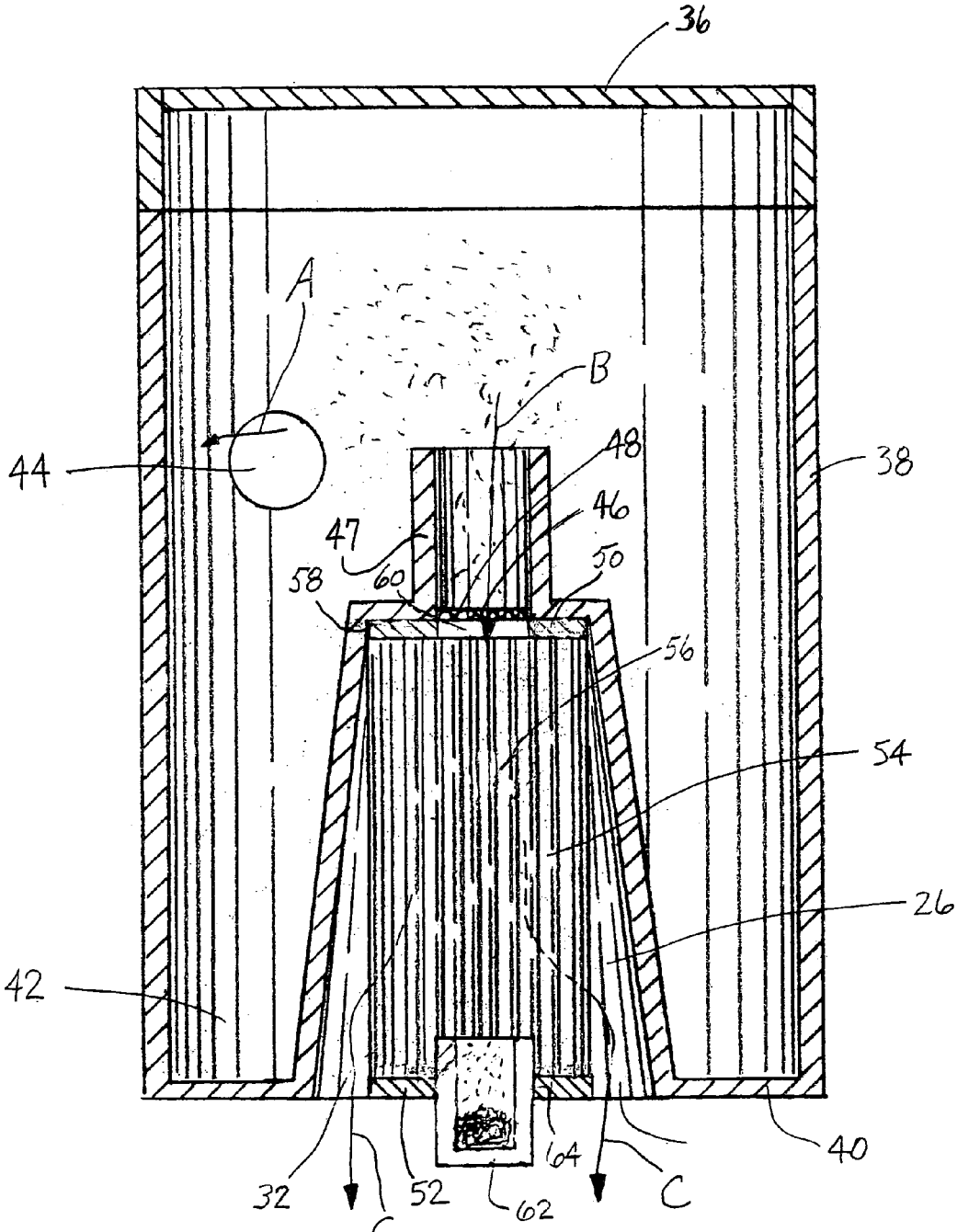

The accompanying drawing incorporated in and forming a part of this specification, illustrates several aspects of the present invention, and together with the description serves to explain certain principles of the invention. In the drawing:

FIG. 1 is a perspective view of the vacuum cleaner of the present invention; and FIG. 2 is a partially schematical and cross-sectional view of the dirt cup of the present invention.

Reference will now be made in detail to the present preferred embodiment of the invention, an example of which is illustrated in the accompanying drawing.

DETAILED DESCRIPTION OF THE INVENTION

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent covers canister and hand-held, bagless vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner to and fro across the floor. Wheels (not shown) carried on the housing 12 allow the vacuum cleaner 10 to be moved smoothly across the floor.

As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly) and a dirt cup 24 including a filter cavity 26 (see also FIG. 2). The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. That dirt and debris is then drawn by the suction generator 22 through the nozzle inlet 18 into the dirt cup 24 where the majority of the dirt and debris and, more particularly, the relatively coarse dirt and debris is collected. Next, the relatively clean air is drawn through the filter cavity 26 where a filter element 32 cleans the air of substantially any remaining fine particles. The airstream is then directed over the motor of the suction generator 22 to provide cooling before being routed through a final filter, to remove any carbon particles stripped from the suction fan and motor by the airstream, before exhausting the airstream through an exhaust port 34 into the environment.

The dirt cup 24 of the present invention includes a top wall 36, a sidewall 38 and a bottom wall 40 that define a dirt collection chamber 42. In the illustrated embodiment the top wall 36 is formed by a removable lid. An inlet 44 is provided in the sidewall. In one possible embodiment of the dirt cup 24, the dirt collection chamber is substantially cylindrical in shape. Further, the inlet is substantially tangentially directed with respect to the dirt collection chamber 42. This structural arrangement induces a vortex airstream in the dirt collection chamber 42 and provides the added cleaning efficiency of cyclonic action.

As further illustrated in FIG. 2, the bottom wall 40 includes a concavity that defines the filter cavity 26. Further, the chamber outlet 46 is provided in the bottom wall 40. In the illustrated embodiment the chamber outlet 46 sits at the bottom of an extension conduit 47 so that the chamber outlet is effectively provided at a height in the dirt cup 24 substantially equal to or above the inlet 44. A screen 48 or other filtering structure is provided over the chamber outlet 46 so as to prevent relatively coarse dirt and debris from exiting the dirt collection chamber 42 and entering the filter cavity 26. The screen 48 may be provided at either the top or bottom of the conduit 47. Accordingly, coarse dirt and debris collects in the bottom or annular portion of the dirt collection chamber 42 while relatively clean air passes through the screen 48 into the filter cavity 26.

As illustrated, the filter element 32 is received in the filter cavity 26. The filter element 32 includes a frame having a first end wall 50, a second end wall 52 and a sidewall 54. Together, the first end wall 50, second end wall 52 and sidewall 54 define an interior chamber 56. In the illustrated embodiment the sidewall 54 is formed from a filter media of a type known in the art which filters fine debris from the airstream while allowing the airstream to pass freely therethrough.

The filter element 32 may be mounted in the filter cavity 26 in a number of ways. In the illustrated embodiment, the outer edge of the first end wall 50 is threaded to cooperatively engage a threaded section 58 of the bottom wall 40 at the top of the concavity.

An inlet 60 is provided in the first end wall 50 and allows fluid communication with the interior chamber 56. Air exiting the dirt collection chamber 42 passes through the screen 48 and then enters the interior chamber 56 through the inlet 60. That air is then drawn through the filter media of the sidewall 54. Relatively fine dirt and debris capable of passing through the screen 48 is captured in the interior chamber 56 by the filter media. A removable dirt trap 62 held in an aperture 64 in the second end wall 52 is provided to receive and hold the fine particles that become entrapped in the interior chamber 56.

In the illustrated embodiment, the filter element 32 is substantially cylindrical in shape. Further, the airstream is directed through the filter element 32 in a unique manner. Specifically, air is axially directed through the inlet 60 into the interior chamber 56. The air is then radially discharged from the interior chamber 56 through the filter media of the sidewall 54.

In operation, the rotary agitator 20 brushes and beats dirt and debris from the nap of an underlying carpet being cleaned. That dirt and debris is drawn by the suction generator 22 through the nozzle inlet 18. It is then delivered through the inlet 44 into the dirt collection chamber 42 (note action arrow A). Relatively coarse dirt and debris is trapped in the dirt collection chamber by the screen 48. The partially cleaned airstream is then directed through the axial inlet 60 into the interior chamber 56 of the filter element 32 (note action arrow B). The airstream is then drawn through the filter media of the sidewall 54 which functions to trap relatively fine particles that pass through the screen 48 in the interior chamber 56 for collection in the dirt trap 62 (note action arrow C). The now clean airstream is drawn by the suction generator over the motor of the suction generator 22 to provide cooling. The air is then filtered one final time to remove any carbon that might have been picked up from the motor brushes before being exhausted into the environment through the exhaust port 34.

The foregoing description of the preferred embodiment of the invention has been presented for purposes of illustration and description. It is not intended to be exhaustive or to limit the invention to the precise form disclosed. Obvious modifications or variations are possible in light the above teachings.

For example, the dirt collection chamber 42, filter cavity 26 and filter element 32 may assume substantially any other shape. While the illustrated embodiment takes advantage of the added cleaning efficiency provided by cyclonic airflow, the present invention is not limited to cyclonic airflow embodiments. Further, while the suction generator 22 in the illustrated embodiment is located downstream from the dirt cup 24 it could also be located upstream therefrom. Thus, it should be appreciated that the present invention may be utilized on "dirty air" vacuum cleaner systems.

The embodiment was chosen and described to provide the best illustration of the principles of the invention and its practical application to thereby enable one of ordinary skill in the art to utilize the invention in various embodiments and with various modifications as are suited the particular use contemplated. All such modifications and variations are within the scope of the invention as determined by the appended claims when interpreted in accordance with the breadth, to which they are fairly, legally and equitably entitled. The drawings and preferred embodiment do not and are not intended to limit the ordinary meaning of the claims and their fair and broad interpretation in any way.

The invention claimed is:

1. A vacuum cleaner, comprising:

a housing;

a nozzle inlet;

a suction generator carried on said housing;

a dirt cup including a dirt collection chamber, a chamber inlet, a filter cavity and a chamber outlet providing fluid communication between said dirt collection chamber and said filter cavity; and a filter element received in said filter cavity and attached to the dirt cup via a twist fit, wherein said filter element includes an interior chamber, an inlet in communication with said interior chamber and a filter media through which air passes as said air exits from said interior chamber.

2. The vacuum cleaner of claim 1, wherein said dirt cup includes a top wall, a sidewall and a bottom wall.

3. The vacuum cleaner of claim 2, wherein said top wall is formed by a removable lid.

4. The vacuum cleaner of claim 2, wherein said inlet is provided in said sidewall.

5. The vacuum cleaner of claim 4, wherein said dirt collection chamber is cylindrical in shape and said inlet is substantially tangentially directed relative to said dirt collection chamber.

6. The vacuum cleaner of claim 2, wherein said fitter cavity is formed in said bottom wall.

7. The vacuum cleaner of claim 6, wherein said chamber outlet is provided in said bottom wall.

8. The vacuum cleaner of claim 7, further including a screen over said chamber outlet.

9. The vacuum cleaner of claim 8, wherein said filter cavity is frustoconical in shape.

10. The vacuum cleaner of claim 9, wherein said filter cavity flares from said inlet end toward said outlet end.

11. The vacuum cleaner of claim 10, wherein at least a portion of said dirt collection chamber is annular in shape.

12. The vacuum cleaner of claim 11, wherein a conduit is provided between said chamber outlet and said dirt collection chamber.

13. The vacuum cleaner of claim 12, wherein said housing includes a nozzle section including said nozzle inlet and a canister section.

14. The vacuum cleaner of claim 13, wherein said nozzle section and canister section are pivotally connected together.

15. The vacuum cleaner of claim 1, wherein the filter element includes a structure that engages a coopering structure on a bottom wall of the dirt cup.

16. The vacuum cleaner of claim 1, wherein the filter element is threaded to engage a threaded section of the filter cavity.

17. A vacuum cleaner, comprising:

a housing;

a nozzle inlet;

a suction generator carried on said housing;

a dirt cup including a dirt collection chamber, a chamber inlet, a filter cavity and a chamber outlet providing fluid communication between said dirt collection chamber and said filter cavity; and a filter element received in said filter cavity, wherein the fitter element holds a dirt trap in an aperture of the filter element.

18. The vacuum cleaner of claim 17, wherein the filter element is threaded to engage a threaded section of the filter cavity.

19. A vacuum cleaner, comprising:

a housing;

a nozzle inlet;

a suction generator carried on said housing;

a dirt cup including a dirt collection chamber, a chamber inlet, a filter cavity and a chamber outlet providing fluid communication between said dirt collection chamber and said filter cavity; and a filter element received in said filter cavity and attached to the dirt cup via a twist fit, said filter element includes a first end having a fitter inlet, a second end and a sidewall defining an interior chamber.

20. The vacuum cleaner of claim 19, wherein said sidewall is made at least partially from a filter media.

21. The vacuum cleaner of claim 20, wherein said second end wall holds a dirt trap.

22. The vacuum cleaner of claim 21, wherein said fitter element is cylindrical in shape.

23. A vacuum cleaner, comprising:

a housing;

a nozzle inlet;

a suction generator carried on said housing;

a dirt cup including a dirt collection chamber, a chamber inlet, a filter cavity and a chamber outlet providing fluid communication between said dirt collection chamber and said filter cavity, wherein said dirt cup includes a top wall, a sidewall and a bottom wall, and said filter cavity is formed in said bottom wall; and a filter element received in said filter cavity and attached to the dirt cup via a twist fit.

24. The vacuum cleaner of claim 23, wherein said chamber outlet is provided in said bottom wall.

25. The vacuum cleaner of claim 24, further including a screen over said chamber outlet.

26. The vacuum cleaner of claim 25, wherein said filter cavity is frustoconical in shape.

27. The vacuum cleaner of claim 26, wherein said filter cavity flares from said inlet end toward said outlet end.

28. The vacuum cleaner of claim 27, wherein at least a portion of said dirt collection chamber is annular in shape.

29. The vacuum cleaner of claim 28, wherein a conduit is provided between said chamber outlet and said dirt collection chamber.

30. The vacuum cleaner of claim 29, wherein said housing includes a nozzle section including said nozzle inlet and a canister section.

31. The vacuum cleaner of claim 30, wherein said nozzle section and canister section are pivotally connected together.

* * * * *

UNITED STATES PATENT AND TRADEMARK OFFICE

CERTIFICATE OF CORRECTION

PATENT NO. : 7,231,688 B2
APPLICATION NO. : 10/679845
DATED : June 19, 2007
INVENTOR(S) : Amy N. Mudd It is certified that error appears in the above-identified patent and that said Letters Patent is hereby corrected as shown below:

Claim 6, column 5, line 1, replace “fitter” with -- filter --.

Claim 15, column 5, line 22, replace “coopering” with -- cooperating --.

Claim 17, column 5, line 36, replace “fitter” with -- filter --.

Claim 19, column 6, line 3, replace “fitter” with -- filter --.

Claim 22, column 6, line 10, replace “fitter” with -- filter --.

Signed and Sealed this

Fourth Day of September, 2007

JON W. DUDAS
*Director of the United States Patent and Trademark Office*